United States Patent [19]

Dahlquist

[11] 4,239,090

[45] Dec. 16, 1980

[54] HIGH ACCURACY BASS REPRODUCER DEVICE

[76] Inventor: Jon G. Dahlquist, 601 Old Willets Path, Hauppauge, N.Y. 11787

[21] Appl. No.: 25,089

[22] Filed: Mar. 29, 1979

[51] Int. Cl.[3] ..... H04R 7/16

[52] U.S. Cl. ..... 181/172; 181/174; 181/151; 179/115.5 VC

[58] Field of Search ..... 181/171, 172, 173, 174, 181/148, 157, 151; 179/115.5 VC, 115.5 R

[56] References Cited

U.S. PATENT DOCUMENTS

| | | | |
|---|---|---|---|
| 1,824,590 | 9/1931 | Bernard | 181/171 |
| 2,014,621 | 9/1935 | Jensen | 181/171 |
| 2,775,309 | 12/1956 | Villchur | 181/151 |
| 2,860,721 | 11/1958 | Hassan | 181/172 |
| 3,767,004 | 10/1973 | Liebscher | 181/172 |

FOREIGN PATENT DOCUMENTS

| | | | |
|---|---|---|---|
| 2810930 | 9/1978 | Fed. Rep. of Germany | 181/172 |
| Ad. 43928 | 7/1934 | France | 179/115.5 VC |
| 292739 | 6/1928 | United Kingdom | 179/115.5 VC |
| 331828 | 7/1930 | United Kingdom | 179/115.5 R |

*Primary Examiner*—L. T. Hix
*Assistant Examiner*—Benjamin R. Fuller
*Attorney, Agent, or Firm*—Mark T. Basseches; Paula T. Basseches

[57] ABSTRACT

The present invention is directed to an apparatus for reproducing the bass components of an audio signal with a high degree of accuracy and minimal distortion, utilizing an enclosure of relatively small size. The apparatus comprises a substantially sealed enclosure in combination with a radiating diaphragm driven by an electromagnetic transducer, the principal diaphragm restoring forces being the elastic forces exerted against the diaphragm surfaces by the gaseous medium engaging such surfaces. The device is characterized by the elimination of the roll or surround joining the cone to the frame as heretofore always employed in reproducers of the air suspension type as the means for effecting a sealing of the enclosure, and the utilization of a rigid peripheral portion of the diaphragm immediately adjacent a parallel interior surface portion of the transducer mechanism to define a gap of minimal dimension, said gap being elongated in the direction of movement of the diaphragm, the clearance provided by said gap being maintained at minimal value consonant with movements of the diaphragm free from mechanical interference.

7 Claims, 4 Drawing Figures

HIGH ACCURACY BASS REPRODUCER DEVICE

The present invention is in the field of sound reproduction and pertains more particularly to an apparatus for reproducing in an enclosure of relatively small size the bass frequencies of sound with a degree of accuracy or freedom from distortion not heretofore obtainable in enclosures of any size.

The art of sound reproduction has progressed substantially over the past several decades. Changes in the electronic components providing the amplification of audio signals have reduced electronic distortion components to virtually immeasurable values. Transduction components for translating the magnetic information contained on a tape or the mechanical information contained on a record have likewise undergone significant improvement to the point where only minimal colorations are introduced at such stages of the sound reproduction process. The principal source of coloration and distortion of the reproduced audio signal remains the loudspeaker which converts the electrical impulses impressed thereon into acoustical energy.

While numerous advances of an evolutionary nature have reduced the sonic coloration introduced by loudspeaker devices, and particularly sonic information in the so-called midrange or treble frequencies to tolerable, if not inaudible levels, progress in reducing bass frequency colorations has not kept pace. By way of example, although it is possible through the use of currently available sound reproducing equipment of moderate price to maintain total electronic distortion products below 0.05%, conventional bass reproducing loudspeaker devices are unable to approximate distortion levels even ten times this amount when they are driven to realistic listening levels.

It is not here practicable to review in detail the many expedients attempted in an effort to minimize bass distortion of loudspeakers. In general, an area of experimentation has involved the chemical treatment of radiating diaphragms to reduce nodes and resonances in the diaphragm itself and the use of a variety of cone substances.

Further efforts have involved the provision of complex loading or coupling systems including enclosures defining horns, ported enclosures of various types, and so-called air suspension reproducers, such as shown in U.S. Pat. No. 2,775,309. This patent represented a significant advance in the art in that bass reproduction at realistically high levels with distortion products as low at 2 or 3% was achieved in enclosures of relatively small size.

In the so-called air suspension system of bass reproduction, the transducer diaphragm constitutes a boundary of a sealed enclosure within which is entrapped an elastic medium (air). In such system, movement of the diaphragm inwardly of the enclosure produces a compression of the entrapped elastic medium, such compressed medium providing a relatively linear restoring force acting equally over the surface of the diaphragm. Such linear acting restoring force avoided, to a degree, the non-linear distortions inherent in loudspeaker devices theretofore used wherein an elastic connection is effected between the periphery of the diaphragm and a frame surrounding the periphery.

Such elastic surround mechanisms obviously involve non-linear force components by virtue of the fact that the restoring force urging the diaphragm to its "at rest" or neutral position increases progressively as the diaphragm is displaced from its neutral position.

U.S. Pat. No. 2,775,309 employed a suspension system having greatly reduced reliance on mechanical restoring force and increased reliance on compressed (or rarefied) medium to effect control of the radiating diaphragm. The subject patent employed at the interface between the diaphragm periphery and the enclosure a highly compliant roll or surround defining a seal at the interface of the diaphragm and enclosure but nonetheless permitting relative movement between the diaphragm and the enclosure without introducing significant restoring forces to the diaphragm.

The state of the art to the present, and particularly the state of the art as pertinent to electromagnetic transducers, has thus embodied one or the other of the two principles hereinabove briefly discussed, namely, the use of a mechanical surround interposed between the diaphragm and a structural support therefor, with its inherent non-linearity characteristics, or a highly compliant, non-force exerting roll or surround functioning as an air seal but not introducing significant restoring forces to the cone periphery.

I have discovered that the highly compliant roll or surround employed in air suspension sound reproducing devices as exemplified in U.S. Pat. No. 2,775,309 and conceived as a means for avoiding the non-linear distortions present in transducers theretofore known is itself a source of subsidiary distortion products, phase interference and cancellation effects. Specifically, the highly compliant sealing roll or surround used in air suspension systems heretofore known has been found to act as a sound generating and radiating medium or mechanism acting, in large part, in opposition to the sound generated by the main radiating diaphragm.

More particularly, I have discovered that as the radiating diaphragm of an acoustic suspension system is drawn inwardly into the enclosure, with concomitant increased compression of the enclosed elastic gaseous medium, the compressed medium tends to force the highly compliant sealing roll or surround in an outward direction exactly opposite to the direction which the diaphragm is being drawn by the magnet-voice coil assembly. Thus, while the diaphragm, as perceived from outside the enclosure, is producing a rarefaction on its inward stroke, the surround is forced outwardly by the enclosed gas and produces a compression of an unpredictable nature in opposition to the rarefaction.

While the total area of the surround is substantially less than that of the diaphragm and thus the sonic effects produced thereby are smaller than the sonic effects produced by movements of the diaphragm, the sound output of the surround is sufficiently great to introduce substantial distortion products to the overall signal. The distortion products are observed as boominess, hangover, and particularly blurring of bass transients. The sudden transient attack, for instance, of a bass drum which is struck is perceived as a muddled or muddied sound due to the spurious effects introduced by the oppositely moving roll or surround.

It is important to note that the roll generated sounds are of substantially opposite phase from the phase of the sounds generated by the diaphragm and that cancellation effects and time delay distortion among other types of distortion, including break-up of the extremely flexible roll material, inevitably result from the use of conventional air suspension woofers.

I have discovered that although it had heretofore been considered that a completely sealed enclosure is necessary for a satisfactory air suspension system, satisfactory air restoring forces on the diaphragm can be generated through the use of an enclosure sealed except for the front aperture occupied by the driven diaphragm, provided that the diaphragm periphery and the adjacent static surfaces of the enclosure or speaker frame component adjacent the periphery of the diaphragm are elongated in the direction of movement of the diaphragm and if the clearance or gap between the diaphragm periphery and adjacent edge of the opening is sufficiently small.

I have found that by maintaining the total cross-sectional area of the gap within selected low limits, and elongating said gap in the direction of movement of the diaphragm to a length of about 1.5 cm or more, the turbulence effects about the periphery of the diaphragm in the gap area are such as to retain sufficient of the reactive stiffness of the elastic enclosed medium to obtain the essentially linear resistance and restoring forces noted in the aforesaid U.S. Pat. No. 2,775,309 without the use of a flexible surround or roll with its attendant colorations and distortions.

I have further discovered that by properly forming or configurating the interfitting surfaces of the periphery of the diaphragm, the problem of rubbing or scraping of the diaphragm periphery against static components is eliminated by the flow of air through the gap, which functions to center the diaphragm. Numerous variations in the shape or configuration of the diaphragm periphery and/or adjacent static surfaces in order to obtain modified flow patterns have unexpectedly been found significantly to modify the tolerable gap clearances.

Briefly, as more fully set forth hereinafter, the invention may be summarized as directed to an enclosure sealed except for an opening, which opening is filled with a diaphragm which is relatively stiff, at least at its periphery, which diaphragm is driven by a conventional linear acting electromagnetic motor, e. g. a voice coil riding in an annular magnetic gap. The diaphragm includes centering or guide means within the enclosure which enable reciprocal movements in a direction parallel with the axis of the voice coil, the centering means preferably engaging the diaphragm assembly at points longitudinally spaced in the direction of the voice coil axis so as to assure precise axial movement of the diaphragm.

By so configurating and arranging the elongate gap between the periphery and the internal surface of a static portion surrounding the periphery, there is provided a low frequency reproducer apparatus having exceedingly low distortion products of an order comparable to the distortion products of electronic components of a sound reproducing system.

It is accordingly an object of the invention to provide an improved low frequency reproducer assembly.

A further object of the invention is the provision of a low frequency reproducer assembly which includes a sealed enclosure and a diaphragm relatively rigid at least at its periphery portions, the periphery of the diaphragm and the internal surface of the enclosure surrounding the diaphragm defining an elongate gap therebetween, said periphery and surface being free from any surround, roll or like constraint which will interfere with the linear action of the enclosed elastic medium on the movements of the diaphragm.

Still a further object of the invention is the provision of a low frequency reproducer of the type described wherein the sole flow passage from the interior to the exterior of the enclosure is defined by a gap surrounding the moving diaphragm, the dimensions of such gap being such as not to reduce the acoustical stiffness reactance of the fluid medium within said enclosure to a value below about 95% of the theoretical stiffness reactance of said medium if said container were completely sealed. In determining the stiffness reactance, it should be recognized that the turbulence effects generated between the relatively moving parts are such that the stiffness reactance is higher than might be theoretically calculated, considering the area of the gap in a static condition.

A further object of the invention is the provision of a low frequency reproducing device of the type described wherein extremely long excursions of the diaphragm relative to the enclosure may be accommodated, making practical the use of diaphragms which are relatively small in area without sacrifice of sound intensity and without the introduction of distortion components.

To attain these objects and such further objects as may appear herein or be hereinafter pointed out, reference is made to the accompanying drawings, forming a part hereof, in which.

Figure 1:
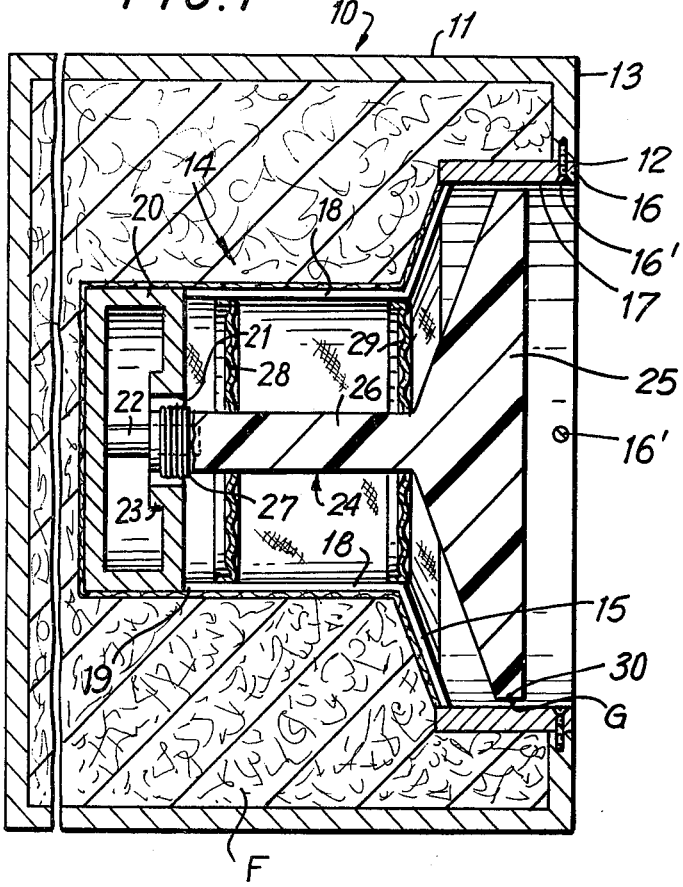
FIG. 1 is a cross-sectional view through a diagrammatically illustrated low frequency reproducer apparatus of the type described.

Turning now to the drawings, there is diagrammatically illustrated in FIG. 1 a bass reproducer device in accordance with the invention. It will be readily appreciated by those skilled in the art that the reproducer device 10 may comprise a separate unit capable of reproducing only the bass frequency range of the musical spectrum or, more usually, may comprise an element of a unitary loudspeaker device capable of reproducing the entire sonic spectrum.

The bass reproducer device 10 includes an enclosure 11, the enclosure being completely sealed except for a circular opening 12 in the front face 13 thereof. A transducer assembly 14 is mounted within the enclosure 11. The transducer assembly includes a frame 15 having an annular flange 16 rigidly secured thereto. The flange 16 is securely mounted in the opening 12, for example by screw members or like fasteners 16' extending radially through the flange and into the front face 13 of the enclosure at angularly spaced-apart positions. In the mounting of the flange 16 within the opening 12, care must be taken to assure an airtight interfit between the noted parts, for which purpose a glue or caulking compound is desirably interposed between the interface of the flange and the opening.

The frame 15 may include a plurality of angularly spaced-apart, rearwardly extending ribs or struts 18, the rearwardmost ends 19 of which carry an essentially conventional magnet assembly 20. The magnet assembly 20 defines an annular magnetic gap 21 between the central pole piece 22 and the annular pole element 23, which gap is axially elongated and preferably of an essentially constant flux density through the length thereof.

The frame member 15 carries a diaphragm assembly 24, the diaphragm assembly including a sound radiating component 25 of substantial diameter, normally in the order of from a minimum of about 6" upwardly to about 12" or more. The diaphragm assembly includes a reduced neck portion 26, to the rearwardmost end of which is secured a voice coil 27. The leads (not shown) from the extremities of the voice coil 27 are secured either to the output terminals of the loudspeaker where the device is to be used as a bass reproducer only, or alternatively, to the bass frequency output taps of a crossover network, where the reproducer constitutes an element of a full range loudspeaker assembly.

The voice coil 27 preferably is elongated in the direction of the axis of the neck portion 26 and is preferably so constructed and arranged that an essentially constant number of turns of the voice coil is disposed within the constant flux magnetic gap throughout the anticipated range of excursions of the diaphragm. Preferably the diaphragm is of the long excursion type wherein deflections of up to about ½" inwardly or outwardly from the null or center position may be achieved.

Suspension means 28, 29 are interposed between the neck portion 26 of the diaphragm assembly and the struts 18 of the frame. The suspension means permit substantial movement of the neck portion inwardly and outwardly while supporting said neck portion against deviation from the desired axial or linear orientation in which it is mounted, i.e. the neck portion is maintained precisely perpendicular to the front surface 13 of the enclosure.

Numerous suspension means have been found suitable for the intended purpose, including specifically a series of corrugated, radially extending resilient or elastic strips, such as the strips 28, 29. Alternatively, the suspension means 28, 29 may comprise annular corrugated, highly compliant disks.

In order to preserve the linearity of movement of the diaphragm assembly, the forces exerted by the suspension in the direction of the axis of the neck portion 26 of the diaphragm are maintained at a minimum. Since, in contrast to conventional loudspeaker assemblies, the suspension means 28, 29 constitute the principal mechanism for maintaining the axial alignment of the diaphragm, the suspension components are preferably spaced apart a substantial distance along the axis of the neck portion 26.

While there has been illustrated in FIG. 1 a pair of suspension means engaging the neck portion at axially displaced positions, it is contemplated that a single suspension means may be employed, provided that alternative means which are, in fact, spaced axially relative to the neck portions are provided for preventing angular deflection of said neck portion.

By way of example and without limitation, the neck portion may be fitted with a cylindrical Teflon sleeve, precision interfitted with a complemental Teflon sleeve made fast to the frame assembly 15 of the transducer, whereby an exceedingly low friction bearing is defined between the parts, with the diaphragm being supported for axial movement.

The enlarged or radiating portion 25 of the diaphragm assembly terminates in a peripheral edge 30, which edge is disposed in intimately spaced relation to the interior surface 17 of the flange 16 to define between the adjacent surfaces 30 and 17 a continuous gap of minimal cross-sectional area. The edge 30 is elongated in the axial direction, as is surface 17, to assure that the gap is of a substantial longitudinal extent, for purposes which will be more fully explained hereinafter.

The diaphragm assembly 26 is preferably fabricated of rigid and lightweight material such as, by way of example, a closed cell Styrofoam material. The mass of the diaphragm assembly should be retained at the lowest possible value consonant with the achievement of structural rigidity. At least the peripheral portion adjacent the surface 30 of the radiating portion 25 of the diaphragm should likewise be comprised of rigid material, it being appreciated that whereas the diaphragm assembly 24 in the illustrated embodiment is disclosed as constituting an integral unit, it is contemplate that for purposes of reducing mass there may be formed internal voids and the interior of the radiating component may be hollow and a treated paper diaphragm component supported in position within the rigid peripheral portion.

It is critical to the satisfactory operation of the instant device, since the same depends largely on the elastic medium disposed within the enclosure as the diaphragm restoring medium, that the total cross-sectional area defined by the gap G between the inner flange surface 17 and the peripheral portion 30 be maintained at the lowest feasible value.

I have unexpectedly discovered that, notwithstanding the existence of the gap G, the speaker assembly will act in the manner of an air suspension speaker, the operating principles of which are fully elaborated on in the above referenced U.S. Pat. No. 2,775,309. More specifically, the noted patent teaches that improved bass reproducing performance may be achieved in an enclosure of small size through the use of an entirely sealed enclosure of which the radiating diaphragm defines a boundary, and further teaches that a complete sealing must be effected in order for satisfactory performance to be achieved.

It is known, for instance, in the use of air suspension speakers commercially available that even unsealed apertures in the enclosure of the magnitude of a screw hole, seriously degrade the sound produced by the device by compromising the elastic restoring effects set forth in the above mentioned patent.

I have discovered that the elastic restoring forces necessary to satisfactory operation of the device as an air suspension speaker are not compromised, notwithstanding the absence of a completely sealed enclosure, provided the air passage which compromises the sealed nature of the enclosure is disposed in surrounding relationship of the radiating surface of the diaphragm, i.e. at the interface between very closely spaced, relatively moving parts. The clearance at the gap must be maintained at a minimal value consonant with efficient production methods and the gap is elongated in the direction of movement of the diaphragm. Gap spacings in the order of as little as 0.01" or less can be commercially attained and provide satisfactorily small total gap areas to retain the desired elastic restoring force. Bass performance of the loudspeaker is not degraded by the diaphragm surrounding gap although the total cross-sectional area of the gap may be many times greater than that of an aperture which, if otherwise located in the enclosure, would significantly compromise bass reproduction.

I have further discovered that modification of the configuration of the surfaces of the relatively moving components at the interface between the diaphragm periphery and flange has a significant effect upon the allowable gap tolerances. Obviously, a configuration which enables satisfactory operation with greater tolerances provides a more commercially desirable structure from the manufacturing standpoint.

More particularly, I have determined that satisfactory restoring forces and, hence, proper acoustical suspension operation, may be achieved where the acoustical stiffness reactance of the fluid medium within the enclosure is maintained at a value not below about 90 to 95% of the theoretical stiffness reactance of said medium if the container were completely sealed.

It will be appreciated that the stiffness reactance will vary in accordance with the mass of the enclosed medium and, thus, in many instances, to avoid standing waves and to reduce the necessary volume of enclosed air for a given desired acoustical compliance, it may be desirable to incorporate quantities of "fiberglass" filler material F within the enclosure surrounding the transducer, and preferably separated therefrom by a layer of fine mesh material. The fiberglass reduces the velocity of propagation of sound in the enclosed medium, and insures isothermal compression of the enclosed fluid, and also acts as an acoustical dampening element whereby, as noted above, standing wave formation is reduced. Other expedients for reducing the formation of standing waves may desirably be employed, such as baffles, etc.

The acoustical stiffness reactants St in dyne/centimeters may be calculated in accordance with the following formula for a static condition of the device:

$$St=(R\ C^2\ A^2)/V$$

where R equals the density of the enclosed medium in grams per $cm^3$; C is the velocity of sound in the enclosed medium in cm per second; A is the area of the diaphragm in $cm^2$, and V is the volume of the enclosure in a $cm^3$.

The above formula is appropriate to calculation of the stiffness compliance of a completely sealed enclosure. In a static condition, the provision of an aperture of the size of the total area defined between the gap and the flange would be expected to have a profound effect upon the said compliance.

Surprisingly, and apparently by virtue of the fact that the gap is defined between relatively moving surfaces, the reduction of the elastic stiffness is not nearly of the magnitude which might theoretically be expected.

Without limitation to any specific theory, it is presently believed that the expected stiffness loss is not experienced by virtue of the formulation, due to turbulence effects at the interface of the moving parts, of a de-facto fluid seal. The existence of such turbulent seal enables the advantages of an acoustical suspension system to be realized without the attendant disadvantages of a sealing acoustical surround, as heretofore considered indispensable. Elimination of the surround has permitted the elimination of the previously described attendant distortions.

Figure 2:
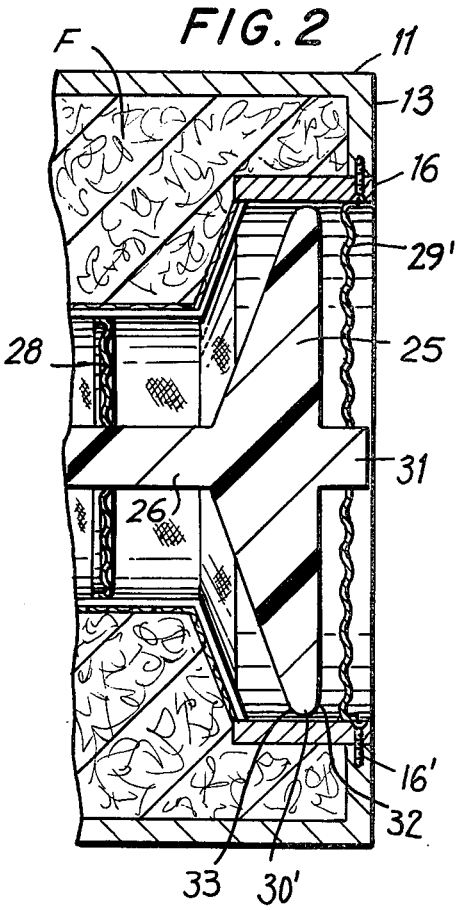
FIG. 2 is a fragmentary vertical sectional view through a diagrammatically illustrated low frequency reproducer in accordance with an embodiment of the invention.

Turning now to the embodiment of FIG. 2, in which like parts have been given like reference numerals, the sound reproducer and the assembly thereof is substantially identical to that of FIG. 1, with the exception that the radiating portion 25 of the diaphragm includes a forward extension 31. A suspension member 29' is interposed in this instance between the extension 31 and surrounding flange 16 or struts extending therefrom, the suspension 29' being preferably comprised of a series of radially directed, angularly spaced-apart, resilient corrugated strips having minimal area. The advantage of such disposition of the forward suspension 29' in greater spaced relation from the rear suspension 28 is in the more efficient application of the supporting forces which offset tilting or departure of the diaphragm from the desired axis of movement.

The peripheral edge 30' of the diaphragm of the embodiment of FIG. 2 includes inclined or part-spherical outer and inner surface portions 32, 33. The utilization of such inclined edges provides a degree of self-centering of the diaphragm in the course of axial movement. Such self-centering is believed to result from the air passing through the gap reacting against the diaphragm in a direction which moves the diaphragm away with progressively greater force as the extent of the gap becomes progressively less.

If, for example, the diaphragm should sag to a slight degree from its optimal position, with the result that one peripheral portion should approach the flange more closely, the air passing through the reduced clearance portion will be preferentially effective to center the diaphragm due to the closer proximity of the flange portion against which air has been deflected by the beveled portions 32, 33.

Additionally, the semi-spherical configuration of the periphery of the diaphragm will permit a degree of axial misalignment without rubbing.

Figure 3:
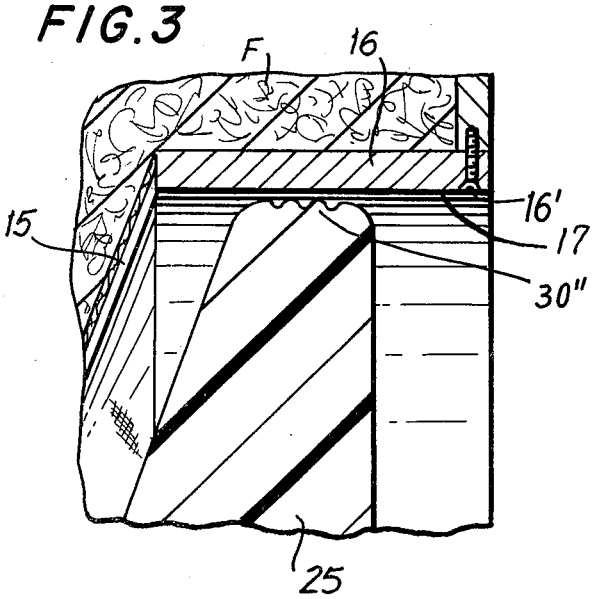
FIG. 3 is a magnified sectional view, diagrammatically illustrating the interface between the diaphragm periphery and surrounding static portions of the device in accordance with a further embodiment.

In FIG. 3 there is disclosed a still further embodiment of the invention wherein the peripheral edge 30'' has been formed with a series of annular corrugations. The existence of such corrugations appears to create augmented turbulent flow patterns at the interface between the inner surface 17 of the flange 16 and the peripheral portion 30'', forming a more effective fluid seal and consequently better preserving the elastic stiffness of the enclosed medium.

Figure 4:
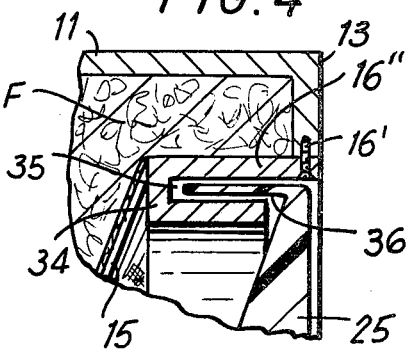
FIG. 4 is a view similar to FIG. 3 showing a still further modification of the invention.

In accordance with the embodiment of FIG. 4, the flange member 16'' is provided with an outwardly facing annular member 34 which is L-shaped in section, thus defining with the flange 16'' an outwardly directed, forwardly open annular chamber 35.

The diaphragm 25 includes at its peripheral portion a cylindrical formation 36 which enters into the chamber 35. It will thus be seen that there is defined a labyrinth for air entering or leaving the enclosure in the gap between the diaphragm and the flange. The provision of such labyrinth has been found to reduce the loss of acoustical elasticity occasioned by the presence of the gap.

It will be readily recognized from the foregoing that the present invention is directed to an improved low frequency sound reproducing apparatus characterized principally in that a diaphragm surrounded by an air gap of minimal cross-sectional extent is mounted for movement in an opening in an otherwise sealed enclosure, the periphery of the diaphragm being free of the usual roll or surround, whereby there is achieved bass reproduction free from the coloration and distortion effects inherent in bass reproduction loudspeakers heretofore known.

It is understood in the light of the instant disclosure that variations may be made in details of construction without departing from the spirit of the invention. Particularly, further experimentation may suggest modifications of the details of the suspension as well as of the shape of the components at the interface defining the gap. By way of example and in order to avoid canting of the diaphragm assembly under the influence of gravity, the diaphragm may be arranged so as to move in a vertical plane and the opening in the enclosure may be located in a horizontally disposed bottom wall. Such arrangement will not interfere with the realism of the sounds produced if the bass frequencies fed to the horizontally arrayed transducer are kept below about 100 Hz, due to the non-directionality of audio signals in this frequency range.

Accordingly, the invention is to be broadly construed within the scope of the appended claims.

Having thus described the invention and illustrated its use, what is claimed as new and is desired to be secured by Letters Patent is:

1. A high accuracy bass frequency sound reproducing device of the acoustical suspension type comprising an enclosure member substantially completely sealed except for an aperture, an electromagnetic transducer disposed within said enclosure and including a frame secured to said enclosure, said frame having a flange portion extending through said aperture, said flange portion including a continuous internal opening, the surfaces defining said opening being aligned parallel with the central axis of said flange, a magnet assembly on said frame including a gap defining a magnetic field, voice coil means disposed within said field and adapted to reciprocate in the direction of said axis responsive to the impression thereon of an alternating electrical current, a diaphragm assembly supported on said frame, said diaphragm assembly including an enlarged radiating portion having a rigid, free peripheral edge elongated in the direction of said axis and a reduced neck portion, said voice coil being mounted to said neck portion, suspension means interposed between said diaphragm assembly and said frame and engaging said diaphragm assembly and frame at at least two positions mutually offset in the direction of said axis for guiding said diaphragm assembly for said reciprocatory movements, said suspension means being attached to said diaphragm assembly at positions remote from said peripheral edge of said radiating portion, said outer peripheral edge of said radiating portion of said diaphragm and said internal opening of said flange defining therebetween a continuous circumferential gap elongated in the direction of said axis and having minimal clearances, said gap defining the sole significant flow passage between the interior and exterior of said enclosure, the total cross-sectional area of said gap being sufficiently small to maintain the acoustical stiffness reactance of the fluid medium within said enclosure at a value to restore said diaphragm assembly to a null position responsive to excursions thereof.

2. A bass reproducer in accordance with claim 1 wherein the area of said gap is such that the acoustical stiffness reactance of said enclosed fluid medium under operating conditions is maintained at least about 90% of the theoretical stiffness reactance of said medium if said container were sealed.

3. A sound reproducer in accordance with claim 1 wherein the leading and trailing edges of said peripheral edge of said radiating portion of said diaphragm assembly are spaced further from said interior surface of said flange than a central portion of said peripheral edge.

4. Apparatus in accordance with claim 3 wherein said free edge portion tapers smoothly from said leading and trailing edges outwardly to said central portion.

5. Apparatus in accordance with claim 1 wherein at least one of the gap defining portions formed by said free peripheral edge of said radiating portion and said interior surfaces of said flange portion juxtaposed to said free peripheral edge include circumferential recesses, thereby to create a turbulence within said gap to interfere with the free flow of air across said gap responsive to movement of said diaphragm assembly.

6. Apparatus in accordance with claim 1 wherein the juxtaposed portions of said free peripheral edge of said diaphragm assembly and said interior surface of said flange define therebetween a discontinuous labyrinth path, thereby to impede the free flow of air across said gap.

7. Apparatus in accordance with claim 1 wherein one of the positions of engagement of said suspension means and said voice coil assembly is inside said enclosure and the other said position is externally of said gap.

* * * * *